United States Patent [19]

Sano et al.

[11] Patent Number: 4,620,497

[45] Date of Patent: Nov. 4, 1986

[54] DEVICE FOR INITIALLY SETTING A COMPUTERIZED SEWING MACHINE

[75] Inventors: Yasuro Sano; Haruhiko Tanaka, both of Tokyo; Eiji Murakami, Hachioji, all of Japan

[73] Assignee: Janome Sewing Machine Co., Ltd., Tokyo, Japan

[21] Appl. No.: 664,883

[22] Filed: Oct. 25, 1984

[30] Foreign Application Priority Data

Oct. 25, 1983 [JP] Japan ..... 58-198403
Oct. 25, 1983 [JP] Japan ..... 58-164044[U]

[51] Int. Cl.[4] ..... D05B 3/02; D05B 69/28
[52] U.S. Cl. ..... 112/453; 112/275
[58] Field of Search ..... 112/158 E, 121.11, 121.12, 112/275, 447, 453, 455, 274

[56] References Cited

U.S. PATENT DOCUMENTS 4,191,120 3/1980 Bergvall ..... 112/158 E
4,271,773 6/1981 Makabe et al. ..... 112/158 E
4,393,794 7/1983 Eguchi et al. ..... 112/158 E

*Primary Examiner*—Peter Nerbun
*Attorney, Agent, or Firm*—Michael J. Striker

[57] ABSTRACT

A position detecting device of a contacting system is incorporated in a computerized sewing machine, which actuates in relation with an output shaft of a pulse motor at an initial setting during sewing operation of a feed control pulse motor or an amplitude control pulse motor, outside of the control region of each of said pulse motors, and the pulse motors are initially set within said control regions by signals from the position detecting device. Therefore a device for initially setting the computerized sewing machine may be provided which is excellent in durability and could promise a stable initial setting for a long period of time.

10 Claims, 18 Drawing Figures

DEVICE FOR INITIALLY SETTING A COMPUTERIZED SEWING MACHINE

BACKGROUND OF THE INVENTION

This invention relates to a device for initially setting device of a computerized sewing machine, and more particularly to a position detecting device of a contacting system actuating in relation with an output shaft of a pulse motor to be initially set within a control region thereof.

SUMMARY OF THE INVENTION

The invention is to incorporate a position detecting device of a contacting system in a computerized sewing machine, which actuates in relation with an output shaft of a pulse motor at initially setting during sewing operation of a feed control pulse motor or an amplitude control pulse motor, outside of the control region of each of said pulse motors, and the pulse motors are initially set within said control regions by signals from the position detecting devices, whereby an initially setting device of the computerized sewing machine may be provided which is excellent in durability and could promise the initial settings stable in a long period of time.

BRIEF DESCRIPTION OF THE DRAWINGS

FIGS. 6 to 9 are views showing each condition of respective main parts of the feed control mechanism, in which FIG. 6 shows Feed "0", FIG. 7 is the maximum forward feed, FIG. 8 is the maximum backward feed, and FIG. 9 shows an actuation of a micro-switch;

FIGS. 11 to 14 concern a second embodiment of the present invention, in which FIG. 11 is a perspective view of dissolved main part of a computerized sewing machine, FIGS. 12 to 14 are views showing each condition of the amplitude control mechanism, and FIG. 12 shows a middle basic line, FIG. 13 shows a left basic line illustrated with the solid line and a right basic line illustrated with the two dotted line, and FIG. 14 shows actuation of a micro-switch;

FIGS. 15 to 18 concern a third embodiment of the present invention, in which FIG. 15 is a perspective view of dissolved main part of a computerized sewing machine, FIGS. 16 to 18 are views showing each condition of the amplitude control mechanism, and FIG. 16 shows a middle basic line, FIG. 17 shows a left basic line illustrated with the solid line and a right basic line illustrated with the two dotted line, and FIG. 18 shows actuation of a micro-switch.

DETAILED DESCRIPTION OF THE PREFERRED EMBODIMENTS

Figure 1:
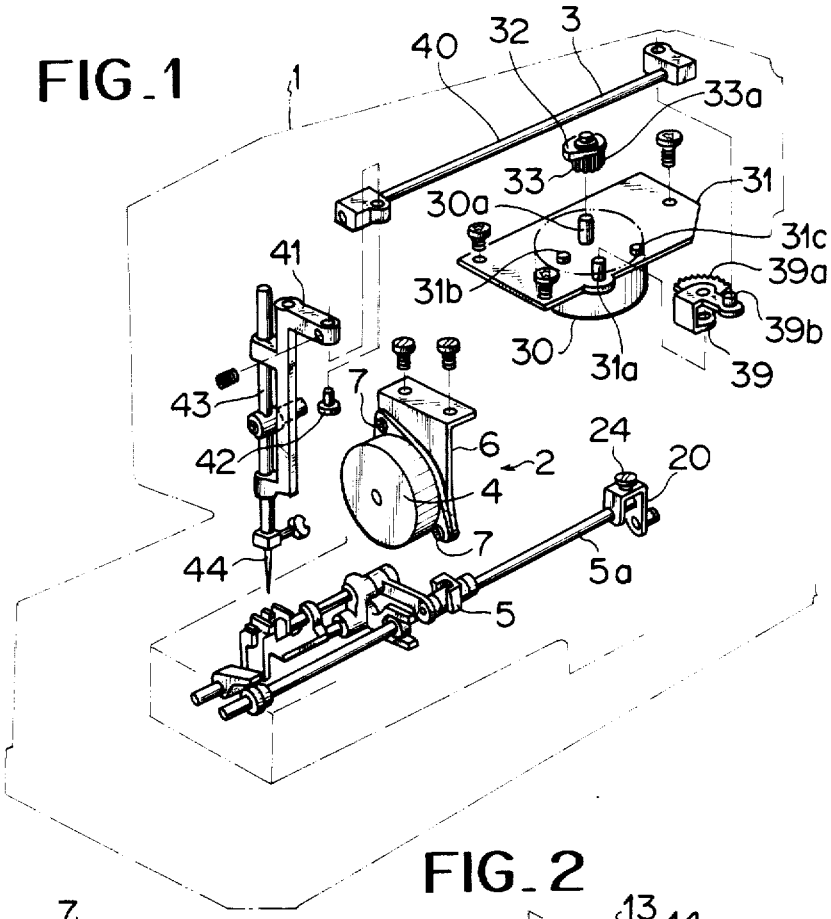
FIG. 1 is a perspective view of a dissolved main part of a computerized sewing machine.

The invention will be explained in reference to the embodiments shown in the attached drawings. In FIG. 1, a computerized sewing machine 1 is provided with a feed control mechanism 2 and an amplitude control mechanism 3.

Figure 2:
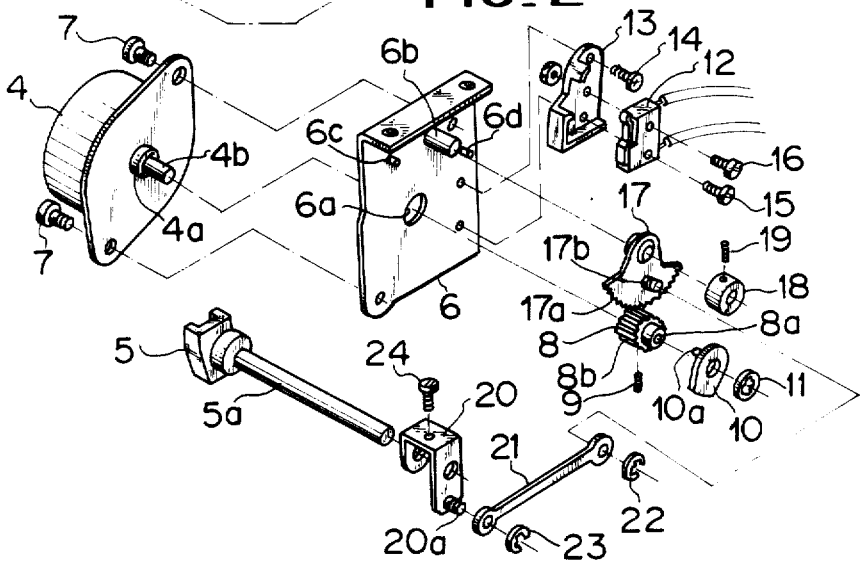
FIG. 2 is a perspective view of dissolved main part of a feed control mechanism.

The feed control mechanism 2 controls obliquity or swinging movement of a feed regulator 5 by means of a feed control pulse motor 4, and a detailed explanation thereof will be made in reference to FIG. 2. The pulse motor 4 is secured to an attached board 6 by screws 7 in that a flange part 4*a* is inserted into a hole 6*a* formed in the attached board 6. An output shaft 4*b* is mounted with a gear body 8 by a screw 9, and a boss 8*a* of the gear body 8 is thrust-stopped with a switch actuating cam 10 by a CS ring 11, so that rotation of the gear body is stopped by a projection 10*a* engaging a thread of a gear 8*b*.

The attaching board 6 firmly holds a position detecting device of a contacting system, i.e., a micro-switch 12 referred to in the present embodiment, together with a switch case 13 by means of screws 14, 15, 16. The micro-switch 12 is, as later mentioned, actuated by a cam 10 outside of the feed control region during sewing operation of the pulse motor 4.

A rod portion 6*b* of the attaching board 6 is pivoted with a gear body 17 having a working gear 17*a* for meshing with the gear 8*b*, and is thrust-stopped by a ring 18 and a screw 19. The gear body 17 is restrained in rotation by means of a pair of pins 6*c*, 6*d* of the attached board 6.

A rod portion 17*b* of the gear body 17 and a rod portion 20*a* of a feed arm 20 are connected via a connecting rod 21, and are thrust-stopped by stopper rings 22, 23. A feed arm 20 is fixed to a shaft part 5*a* of a feed regulator 5 by a screw 24.

The amplitude control mechanism 3 will be explained in reference to FIG. 1. An amplitude control pulse motor 30 is secured to an attaching board 31, and an output shaft 30*a* thereof is secured with a gear 33 having a switch working cam 32.

A vertical pin 31*a* of the attaching board 31 is pivoted with a gear body 39 having a working gear 39*a* for meshing with a gear 33*a*. The gear body 39 is restrained in rotation by means of a pair of pins 31*b*, 31*c* of the attaching board 31. A rod portion 39*b* of the gear body 39 is pivoted with one end of an amplitude transmission rod 40, while the other end of the amplitude transmission rod 40 is pivoted on a pin 42 provided to a needle supporting frame 41 which is swingable via a gear 33, the gear body 39 and the amplitude rod 40 by rotation of the pulse motor 30 in order to control a needle 44.

Figure 3:
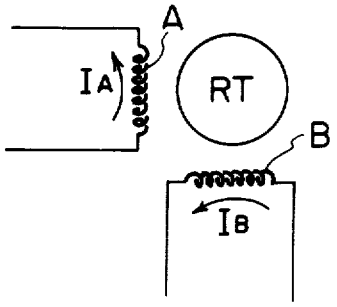
FIG. 3 is a principle view of pulse motors.
Figure 4:
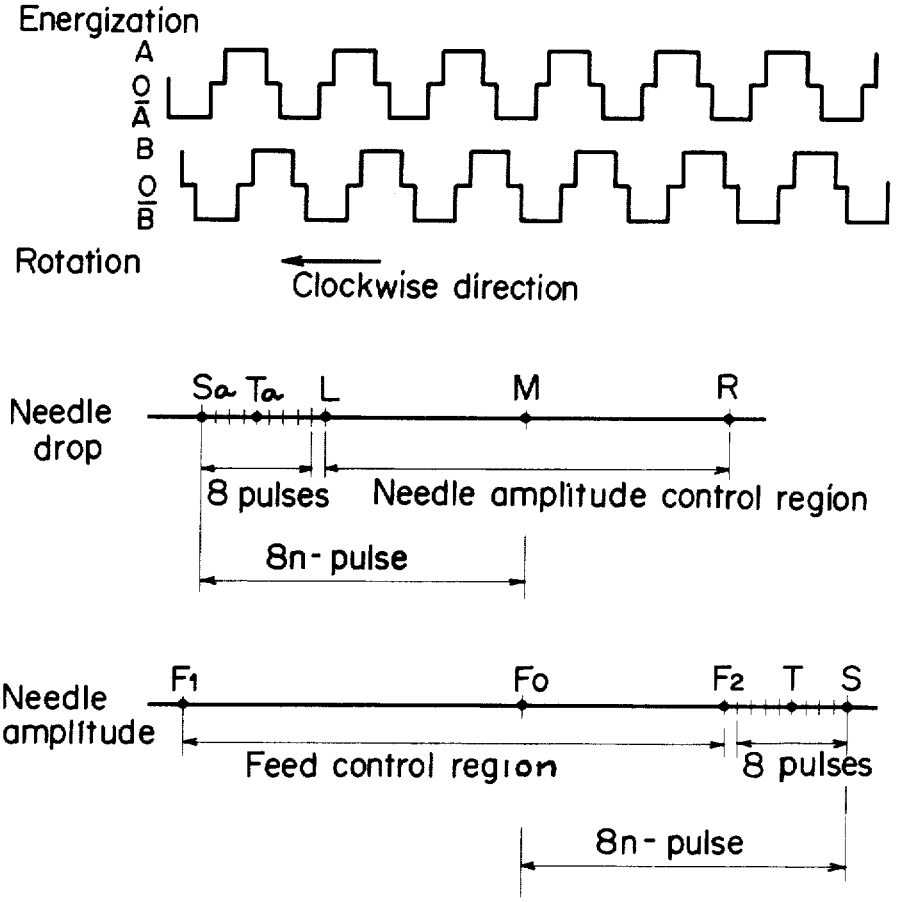
FIG. 4 is linear views showing relation between energization of the pulse motors, needle drop and needle amplitude.

The pulse motors 4 and 30 have, as shown in FIG. 3, rotor (RT) and coils (A), (B) which are 90° in phase angle with respect to the other. The pulse motors are controlled by flowing or breaking of the currents and direction thereof. Herein, when the current $I_A$ flows on the coil (A) in a shown direction or in a reverse direction, they are A phase energized and $\overline{A}$ phase energized, and on the other hand, when the current $I_B$ flows on the coil (B) in a shown direction or in a reverse direction, they are B phase energized and $\overline{B}$ phase energized. Thus, in the present embodiment, after the feed control mechanism 2 and the amplitude control mechanism 3 have been controlled, the energizations of the pulse motors 4 and 30, and needle drop and needle amplitude effected by these energizations, are as shown in FIG. 4.

Figure 6:
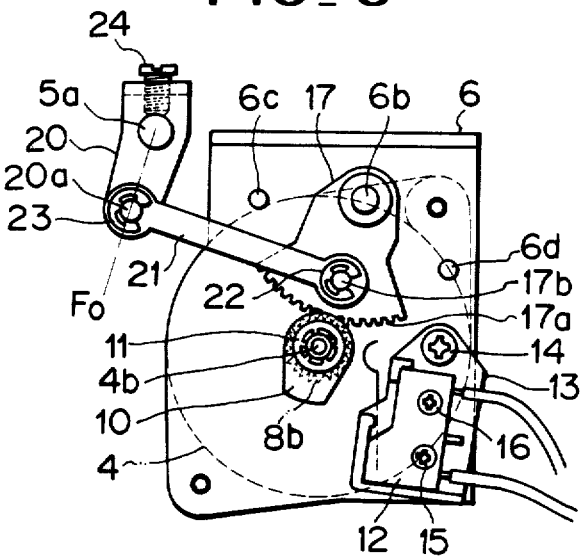
Figure 7:
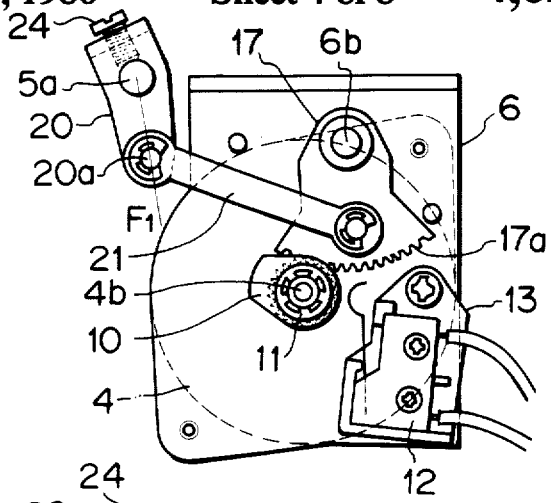
Figure 8:
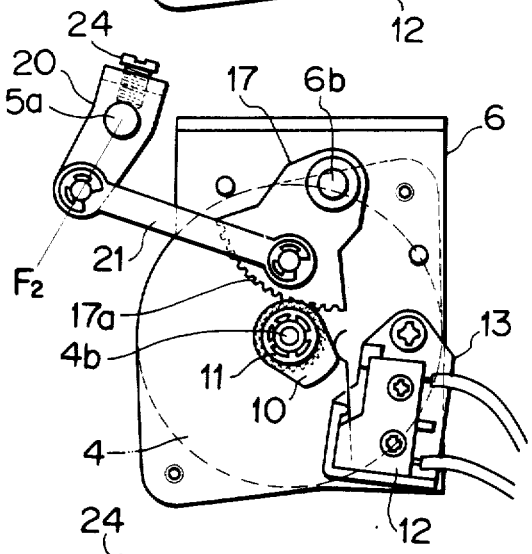

That is, the feed control region of the pulse motor 4 during the sewing operation is between $F_1$ point (mechanically shown in FIG. 7), at which the maximum forward feed is obtained from $F_0$ point (mechanically shown in FIG. 6) at which the feed amount is set to "0", and $F_2$ point (mechanically shown in FIG. 8), at which the maximum backward feed is obtained from $F_0$ point.

Figure 9:
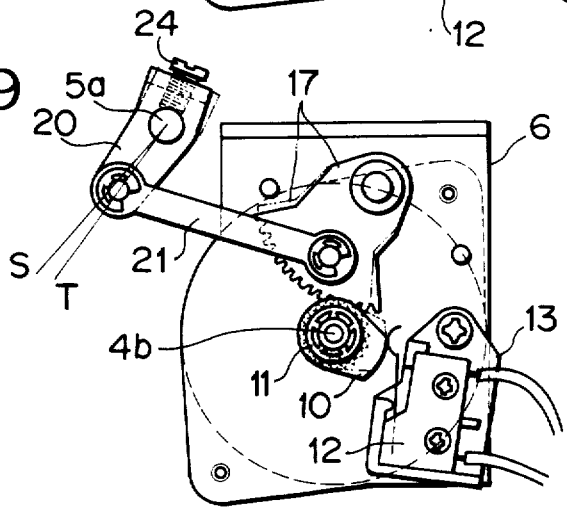

The position detecting micro-switch 12 is turned ON to produce a pulse signal in an additional control region $F_2$-S outside of said feed control region, i.e., T point in the present embodiment (the solid line mechanically shown in FIG. 9) with further counterclockwise rotation by 5 pulses from said $F_2$ point.

The phase of the output shaft 4*b* of the pulse motor 4 before supplying the power source, is not determined.

Figure 5:
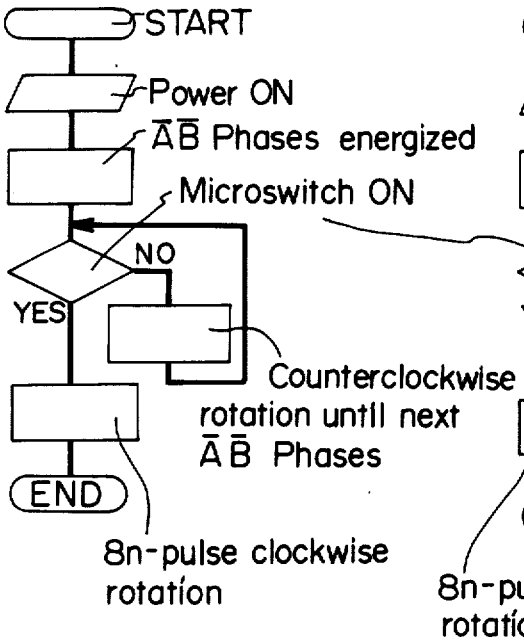
FIG. 5 is a flow chart showing the initially setting operation of the feed control pulse motor.

Therefore, with respect to the initial set control, when the power source is made as shown in FIG. 5, and after $\overline{AB}$ phases are energized on the pulse motor 4, and if the micro-switch 12 is not turned ON, the pulse motor 4 is rotated counterclockwise until next $\overline{AB}$ phases. That is, since these phases are energized per each 8 pulses in this embodiment, the pulse motor is rotated by 8 pulses. After the micro-switch 12 is turned ON to produce a pulse signal for confirming the position of the pulse motor 46, and when the pulse motor comes to the first $\overline{AB}$ phases energized ($\overline{AB}$ phases energized to the most outside, i.e., S point in FIG. 4) which is the starting point for initially setting the sewing machine, the steps of the pulse motor are counted clockwise by $8_n$ pulses ("n" is integer, and in this embodiment n=3) to the point $F_0$ from the starting point S, and the initial setting is made at $F_0$ point where the feeding amount is set to "0".

Figure 12:
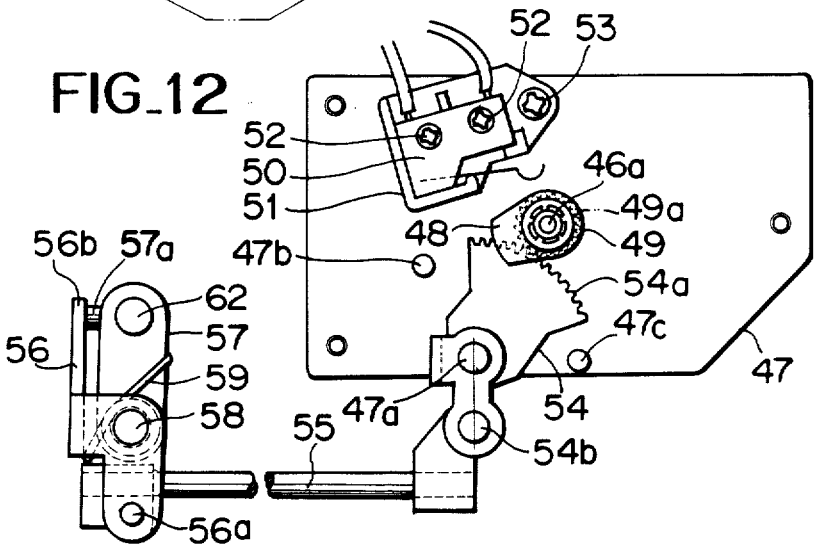

The amplitude control region of the pulse motor 30 during the sewing operation is between L point of a left basic line (the solid line mechanically shown in FIG. 13) of the clockwise control from M point of a middle basic line (mechanically shown in FIG. 12) initially set, and R point of a right basic line (the two-dotted line mechanically shown in FIG. 14) of the counterclockwise control from M point.

A phase where the position detecting micro-switch 34 is turned on the initial setting is in the additional control region $S_o$-L in FIG. 4 outside of said amplitude control region, i.e., Ta point in the present embodiment (mechanically shown in FIG. 14) further clockwise rotating by 5 pulses from L point of the left basic line.

The phase of the output shaft 30*a* of the pulse motor 30 before supplying the power source is not determined.

Figure 10:
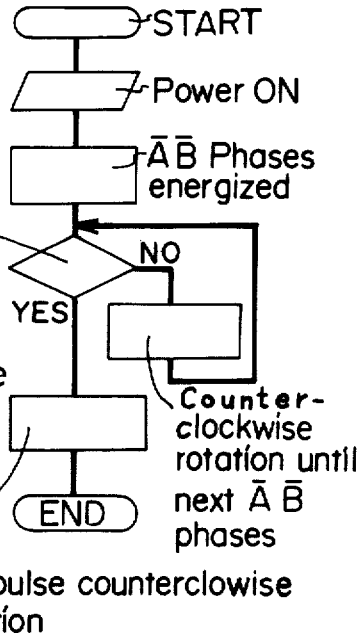
FIG. 10 is a flow chart showing the initially setting operation of the amplitude control pulse motor.

Therefore, with respect to the initial set control, when the power source is made as shown in FIG. 10, and after $\overline{AB}$ phases are energized on the pulse motor 30, and if the micro-switch 34 is not turned ON, the pulse motor 4 is rotated clockwise until next $\overline{AB}$ phases. That is, since these phases are energized per each 8 pulses in this embodiment, the pulse motor is rotated by 8 pulses. After the micro-switch 34 is turned ON to produce a pulse signal for confirming the position of the pulse motor 46, and when the pulse motor comes to the first $\overline{AB}$ phases energized ($\overline{AB}$ phases energized to the most outside, i.e., Sa point in FIG. 4) which is the starting point for initially setting the sewing machine, the steps of the pulse motor are counted counterclockwise by $8_n$ pulses ("n" is integer, and in this embodiment n=3) to the point M from the starting point Sa, and the initial setting is made at M point of the middle basic position.

A reference will be made to an actuation of a first embodiment of this invention. With respect to the initial setting of the feeding amount, when the power source is applied, and after $\overline{AB}$ phases are energized on the pulse motor 4, and if the micro-switch 12 is not turned ON, the pulse motor 4 is rotated by 8 pulsees counterclockwise until next $\overline{AB}$ phases. After the micro-switch 12 is turned ON to produce a pulse signal for confirming the position of the pulse motor 46, and when the pulse motor comes to the first $\overline{AB}$ phases energized ($\overline{AB}$ phases energized to the most outside, i.e., S point in FIG. 4 which is the starting point for initially setting the sewing machine), the steps of the pulse motor are counted clockwise by $8_n$ pulses from the starting point S, and the initial setting is made at $F_0$ point at which the feeding amount is set to "0".

With respect to the initial setting of the amplitude amount, when the power source is supplied, and after $\overline{AB}$ phases are energized on the pulse motor 30, and if the micro-switch 34 is not turned ON, the pulse motor 4 is rotated clockwise by 8 pulses until next $\overline{AB}$ phases. After the micro-switch 34 is turned ON to produce a pulse signal for confirming the position of the pulse motor 34, and when the pulse motor comes to the first $\overline{AB}$ phases energized ($\overline{AB}$ phases energized to the most outside, i.e., Sa point in FIG. 4 which is the starting point for initially setting the sewing machine) the steps of the pulse motor are counted counterclockwise by $8_n$ pulses from the starting point, and the initial setting is made at M point of the middle basic position.

For initially setting the feeding amount and the amplitude amount, the output shafts of the respective pulse motors are initially set within their control regions after the micro-switch is actuated outside of their control regions during sewing operation. Therefore, the device according to the invention is excellent in durability and may provide the stable initial setting for a long period of time.

Figure 11:
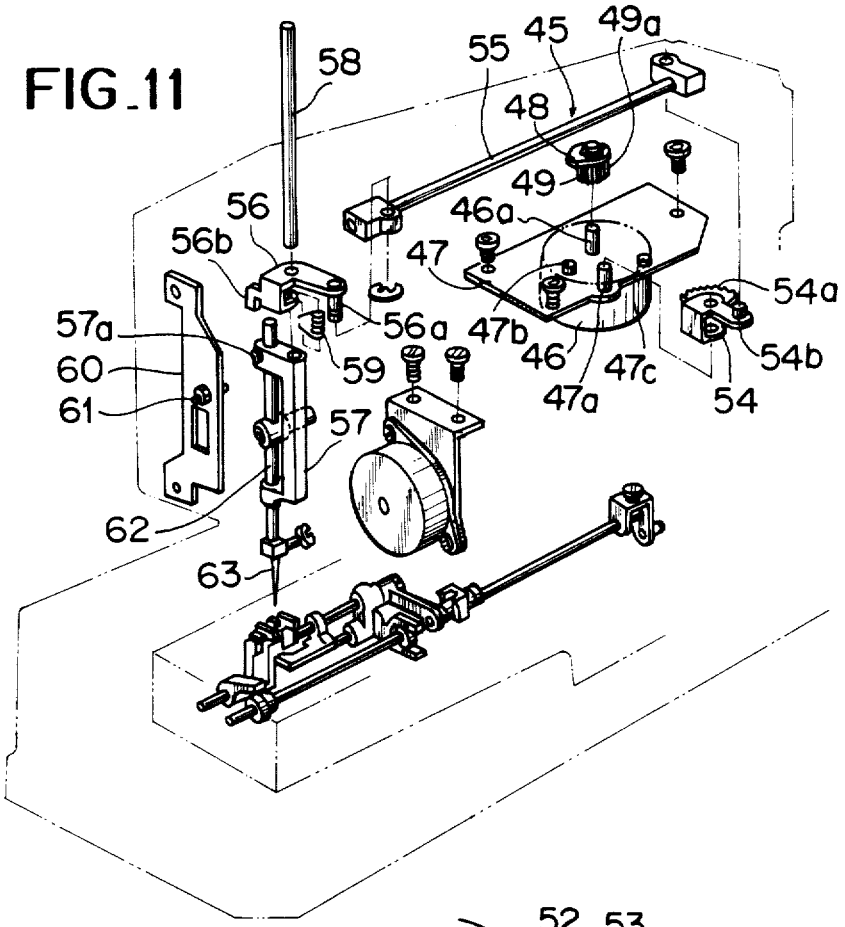

A second embodiment of the invention will be explained in reference to FIGS. 11 to 14, and an amplitude control mechanism 45 will be referred to FIG. 11. An amplitude control pulse motor 46 is secured to an attaching board 47, and an output shaft 46*a* thereof is secured with a gear 49 having a switch operating cam 48.

A vertical pin 47*a* of the attaching board 47 is pivoted with a gear body 54 having a working gear 54*a* for meshing with a gear 49*a*. The gear body 54 is restrained in rotation by means of a pair of pins 47*b*, 47*c* of the attaching board 47. A rod portion 54*b* of the gear body 54 is pivoted to one end of an amplitude rod 55, while the other end of the amplitude transmission rod 55 is pivoted on a pin 56*a*.

A coupling arm 56 is pivoted and swingable around a support shaft 58 together with a needle bar frame 57, and is biased clockwise by an elastic coil spring 59 mounted shaft 58 around the support shaft 58 with respect to the arm 56 and the swingable frame 57. One end 56*b* of the arm 56 is pressed against an engaging portion 57*a* of the swingable frame 57, and the both are turned or swingable as one body around the support shaft 58 during normal driving of the sewing machine.

A stopper plate 60 is furnished within a front plate of the sewing machine, and is provided with a stopper 61 for limiting turning of the swingable frame 57. As the frame 57 is swinginly moved counterclockwise, as shown in FIG. 14, due to the initial setting operation of the pulse motor 46, the stopper 61 engages the frame 57 at a position where the needle bar 62 is slightly outside of the left and of a laterally elongated needle dropping hole 64 and the needle 63 is inside of the needle dropping hole 64 (FIG. 14) of La position.

A reference will be made to an actuation of a second embodiment of this invention. When the power source is supplied, and after $\overline{AB}$ phases are energized on the pulse motor 46, and if the micro-switch 50 is not turned ON, the pulse motor is rotated clockwise by 8 pulses until next $\overline{AB}$ phases. After the micro-switch 34 is turned ON to produce a pulse signal for confirming the position of the pulse motor 46, and when the pulse motor comes to the first $\overline{AB}$ phases energized and to the starting point $S_a$ in FIG. 4, the pulse motor is turned counterclockwise and the steps are counted by $8_n$ pulses, and the initial setting is made at M point of the middle basic position.

Figure 13:
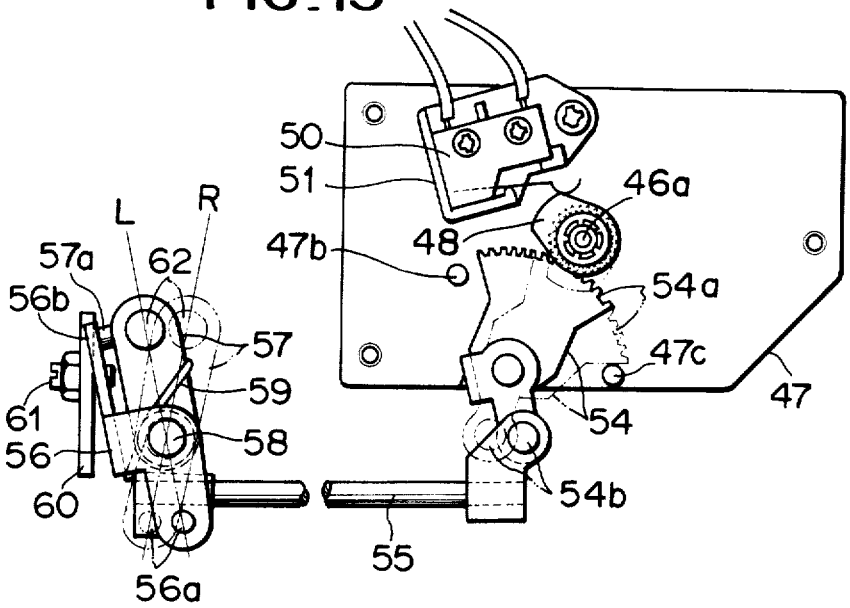
Figure 14:
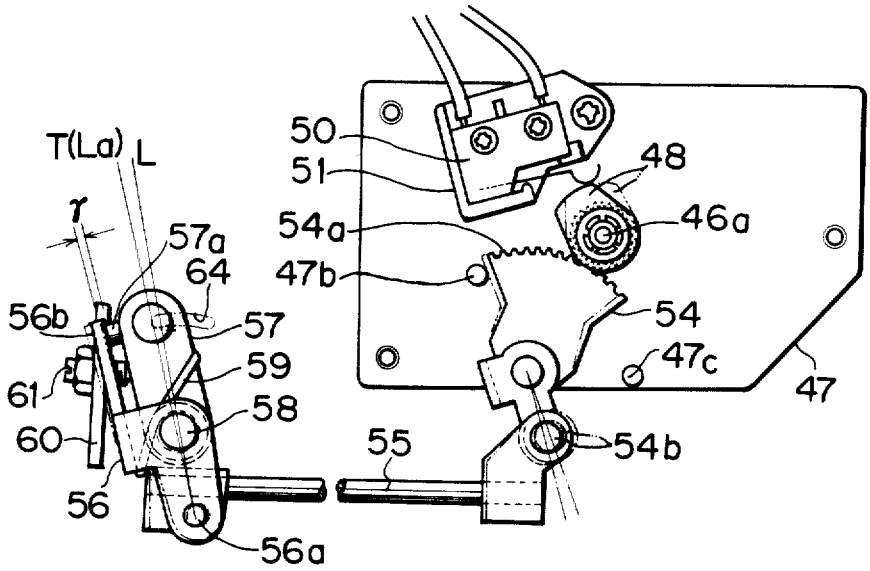
Figure 15:
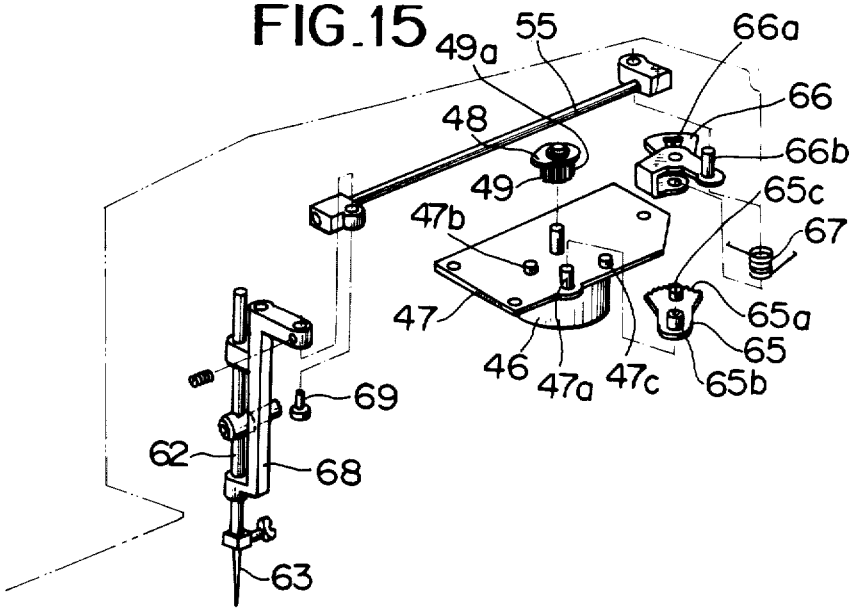
Figure 16:
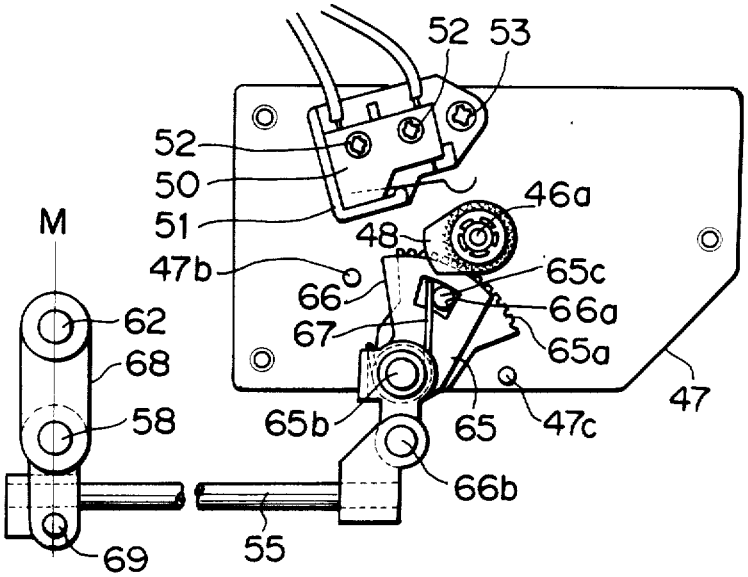
Figure 17:
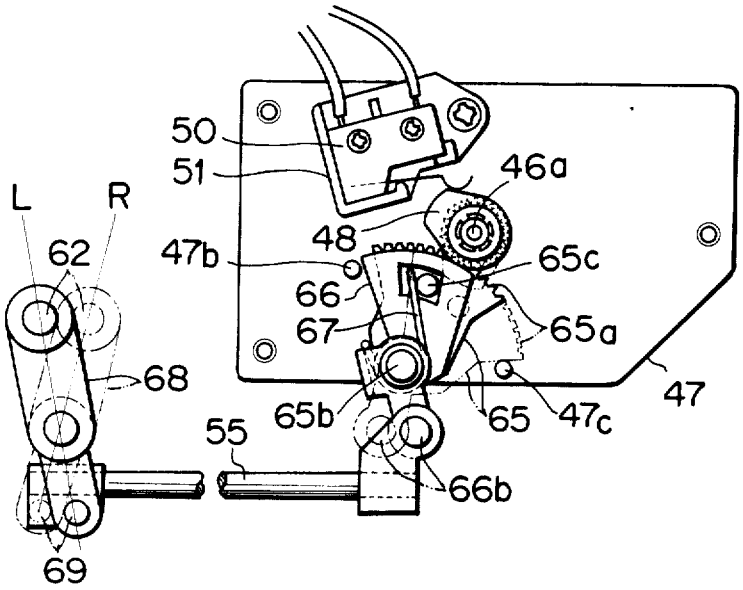

In this initial setting, when the swingable frame 57 and the coupling arm 56 are together rotated counterclockwise as in FIGS. 13 and 14 around the support shaft 58 due to the initial setting of the pulse motor 46 and the pulse motor 46 comes to $T_a$ position as in FIG. 4, the micro-switch 50 is turned ON and at the same time the frame 57 is stopped by the stopper 61 as shown in FIG. 14. Subsequently as the pulse motor 46 reaches $\overline{AB}$ phases energized position at the most outside (Sa point in FIG. 4), only the coupling arm 56 continues to be rotated in the same direction around the support shaft 58 against the biasing force of the coil spring 59. When the pulse motor 46 comes to said S point, the one end 56*b* of the arm 56 is spaced a distance $\gamma$ from the engaging portion 57*a* of the frame 57. Since the swingable frame 57 is stopped by the stopper 61 and the needle 63 is positioned within the needle dropping hole 64, safety may be maintained.

According to this embodiment of the invention, since the initially setting micro-switch 50 is actuated outside of the amplitude control region, the micro-switch will now be operated work at all in the ordinary sewing operation, and it is excellent in durability and may provide the stable initial setting.

A third embodiment of the invention will be explained in reference to FIGS. 15 to 18. In the second embodiment, the coil spring 59 is provided between the coupling arm 56 and the needle bar swingable frame 57 for absorbing the clockwise rotation from the rotation phase, where the pulse motor 46 gives the T position to the needle bar 62 at the initial setting as in FIG. 18, and come to the $\overline{AB}$ phases energized position at the most outside. The coil spring 59 may be positioned at the opposite end of the transmission rod 55. This regard will be referred to without explaining about the same parts, positions or the like.

The vertical pin 47*a* of the attaching board 47 is in pivoted engagement with a working gear body 65 having a working gear 65*a* for meshing with the gear 49. The collar 65*b* of the gear body 65 is inserted into aligned center holes of a coupling arm 66. A vertical projection 65*c* provided on the working gear body 65 projects through a groove 66*a* of the coupling arm 66. An elastic coil spring 67 provided around the collar 65*b* exerts between the projection 65*c* and the coupling arm 66. The arm 66 is biased counterclockwise in FIG. 16 around the collar 65*b* with respect to the working gear body 65. One end of the groove 66*a* is normally pressed against the projection 65*b* of the working gear body 65, and the both members 65, 66 are rotated as one body around the vertical pin 47*a* of the attaching board 47.

A vertical pin 66*b* of the working arm 66 is pivotally connected to one end of the transmission rod 55, opposite to the other end of the transmission rod 55 which is operatively connected to a swingable frame 68 supporting a needle bar 62.

Pins 47*b* and 47*c* of the attaching board 47 are stoppers for limiting movements of the working arm 66 and the working gear body 65. The position where the pin 47*b* stops the working arm 66 corresponds to T position in FIG. 4 the needle bar 62 is slightly outside the left basic line, and the needle is positioned within the needle dropping hole.

An explanation will be made to actuation of the third embodiment. When the power source is supplied, and after $\overline{AB}$ phases are energized on the pulse motor 46, and if the micro-switch 50 is not turned ON, the pulse motor is rotated clockwise by 8 pulses until $\overline{AB}$ phases. When the pulse motor comes, after the micro-switch 50 is turned ON, to the first $\overline{AB}$ phases energized and to the point $S_a$ in FIG. 4, the steps of the pulse motor are counted counterclockwise by $8_n$ pulses, and the initial setting is made at M point of the middle basic position.

Figure 18:
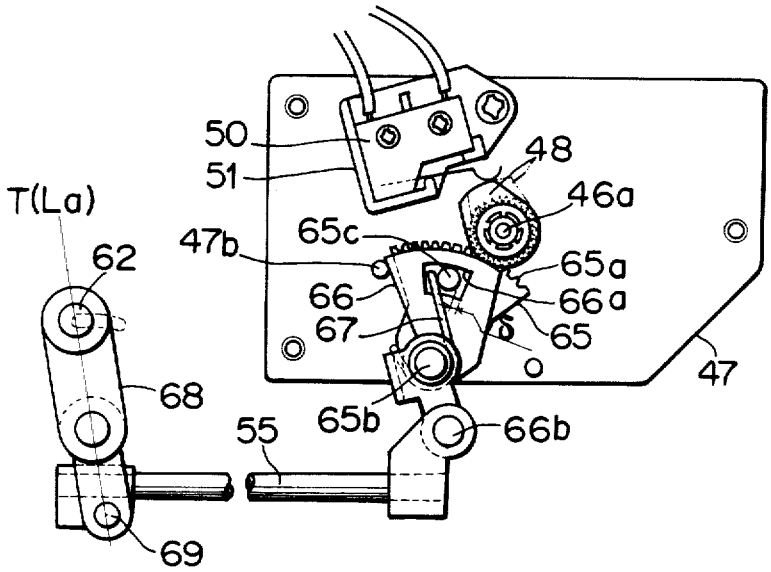

In this initial setting, when the needle bar 62 held by the swingable frame 68 is rotated counterclockwise around the support shaft 58, and comes to T position as shown in FIG. 18, the micro-switch 50 is turned ON and at the same time the swingable frame 68 is stopped at this T position, because the working arm 66 is stopped by the pin 47*b*. Subsequently, as the pulse motor 46 reaches $\overline{AB}$ phases energized position at the most outside (Sa point in FIG. 4), the working gear body 65 continues to be rotated against the biasing force of the coil spring 67 relative to the working arm 66, and the projection 65*c* is separated a distance S from the right side of the groove 66*a*.

According to the present invention, the computerized sewing machine is incorporated with a position detecting device of a contacting system. The device is actuated in relation with rotation of the output shaft of the amplitude control pulse motor at an initial setting, outside of the amplitude control region during the sewing operation of the pulse motor. The elastic material is provided in the amplitude mechanism which connects the output shaft and a needle bar which positions the needle outside of the amplitude control region but inside of the needle dropping hole, in order to absorb the rotation of the output shaft with respect to the stopped needle bar. Thus, the device for initially setting the computerized sewing machine is excellent in durability and safety, and may provide the initial setting stable for a long period of time, and does not drop the needle outside of the needle drop hole at initial setting.

What is claimed is:

1. An apparatus for initially setting a computerized sewing machine upon application of power thereto, the sewing machine having a needle that vertically and swingably reciprocates to variably position within a predetermined region having a plurality of needle positions therein, the apparatus comprising:

a pulse motor moving in steps and operatively connected to the needle and drivable in a control region having a reference point therein, said pulse motor drivable within said control region to variably position said needle within said predetermined region, said pulse motor drivable in an additional control region when the sewing machine is supplied with the power, said additional control region having a starting point therein from which said pulse motor is drivable to said reference point for initially setting the needle to one of said needle positions in said predetermined region;

a cam movable in association with said pulse motor;

detector means including a contact operative switch in said additional control region, said contact operative switch operated to produce a signal in contact with said cam when the latter moves in association with said pulse motor, said signal confirming that said pulse motor is positioned at said starting point in said additional control region from which said steps of said pulse motor are counted to said reference point in said control region; and stopper means including a stopper and a spring, both of which cooperate to prevent said needle from moving beyond said predetermined region when said pulse motor is driven in said additional control region.

2. The apparatus as defined in claim 7; further comprising:

a feed regulator swingably movable in a second predetermined region having a plurality of set positions therein to variably set a fabric feeding amount and a direction thereof;

a second pulse motor having steps and operatively connected to said feed regulator and drivable in a second control region having a second reference point therein, said second pulse motor drivable within said second control region to variably position said feed regulator within said second predetermined region, said second pulse motor drivable in a second additional control region when the sewing machine is supplied with the power, said second additional control region having a second starting point therein from which said second pulse motor is drivable to said second reference point for initially setting said feed regulator to one of said set positions in said second predetermined region;

a second cam movable in association with said second pulse motor; and second detector means including a second contact opertive switch operated to produce a second signal in contact with said second cam when the latter moves in associated with said second pulse motor, said second signal confirming that said second pulse motor is positioned at said second starting point in said second additional control region from which said steps of said second pulse motor are counted to said second reference point in said second control region.

3. The apparatus as defined in claim 1, wherein said pulse motor has a rotatable shaft connected to said needle, said cam secured to said shaft for rotation therewith, and said contact operative switch formed as a microswitch.

4. The apparatus as defined in claim 2, wherein said second pulse motor has a rotatable shaft connected to said needle, said second cam secured to said shaft for rotation therewith, and said second contact operative switch formed as a microswitch.

5. The apparatus as defined in claim 1, wherein the sewing machine has a fixed part; further comprising:

a swingable frame supporting the needle;

a transmission rod having one end operatively connected to said pulse motor and having an other end; and an arm pivotally connected to said other end, said stopper being secured to the fixed part to limit said swingable frame from swinging in one direction, and said spring biasing said swingable frame and said arm.

6. The apparatus as defined in claim 1, wherein the sewing machine has a fixed part; further comprising:

a transmission rod having one end operatively connected to the needle and having an other end;

an arm pivotally connected to said other end; and a gear pivotally mounted on said arm and operatively connected to said pulse motor, said stopper secured to the fixed part, and said spring biasing said arm and said gear.

7. An apparatus for initially setting a computerized sewing machine when supplied with power thereto, the sewing machine having a needle that vertically and swingably reciprocates to provide for variable positioning through a plurality of needle positions within a predetermined region, the apparatus comprising:

a pulse motor having a pulse motor position and being connected to the needle for variably positioning the needle within the predetermined region and movable in a reference control region having a reference location and movable in a starting control region having a starting location when the sewing machine is supplied with the power and movable through a plurality of steps of pulse motor positions from said starting location to said reference location for initially setting the needle to one of said needle positions;

a cam movable in association with said pulse motor;

means for detecting said positions of said pulse motor including a contact operative switch in said starting control region, said switch arranged to contact with cam when said pulse motor is at said starting location to initiate a count of said steps to said reference location when said pulse motor moves toward said reference location; and means for stopping the needle from moving beyond the predetermined region when said pulse motor moves in said starting control region including a stopper cooperating with a spring.

8. The apparatus as defined in claim 9, wherein said detector means produces a signal when contact is made between said switch and said cam for signifying that said pulse motor is at said starting location.

9. The apparatus as defined in claim 7; further comprising:

a feed regulator swingably movable through a plurality of set positions in a second predetermined region to variably set a fabric feeding amount and direction;

a second pulse motor having a second pulse motor position and being movable within a second reference control region having a second reference point and connected to said feed regulator for variably positioning said feed regulator within said second predetermined region and movable in a second starting control region having a second starting location when the sewing machine is supplied with the power and movable from said second starting location to said second reference location for initially setting said feed regulator to one of said set positions;

a second cam movable in association with said second pulse motor; and second means for detecting said second pulse motor position including a second contact operative switch in said second starting control region, said second switch arranged to contact said second cam when said second pulse motor is at said second starting location to initiate a count of said steps of said reference location when said pulse motor moves toward said reference location.

10. The apparatus as defined in claim 9, wherein said second detector means produces a signal when contact is made between said second switch and said second cam for signifying that said second pulse motor is at said second location.

* * * * *

UNITED STATES PATENT AND TRADEMARK OFFICE

CERTIFICATE OF CORRECTION

PATENT NO. : 4,620,497

DATED : November 4, 1986

INVENTOR(S) : Yasuro Sano, et al

It is certified that error appears in the above-identified patent and that said Letters Patent is hereby corrected as shown below:

Col. 7, claim 2, line 1, "claim 7" should be --claim 1--.

Col. 8, claim 8, line 1, "claim 9" should be --claim 7--

Signed and Sealed this

Fifth Day of July, 1988

*Attest:*

*Attesting Officer*

DONALD J. QUIGG

*Commissioner of Patents and Trademarks*